United States Patent [19]

Stopa

[11] Patent Number: 5,013,973

[45] Date of Patent: May 7, 1991

[54] POWER SUPPLY FOR INTERMITTENTLY OPERATED LOADS

[75] Inventor: James L. Stopa, Old Saybrook, Conn.

[73] Assignee: Whelen Technologies, Inc., Chester, Conn.

[21] Appl. No.: 403,379

[22] Filed: Sep. 6, 1989

[51] Int. Cl.[5] ..... H05B 41/14

[52] U.S. Cl. ..... 315/241 R; 315/241 P; 315/200 A; 315/200 R

[58] Field of Search ..... 315/241 R, 200 A, 200 R, 315/241 P

[56] References Cited

U.S. PATENT DOCUMENTS

| | | | |
|---|---|---|---|
| 4,013,921 | 3/1977 | Corthell | 315/241 R |
| 4,027,199 | 5/1977 | Johnson | 315/241 R |
| 4,321,507 | 3/1982 | Bosnak | 315/241 R |
| 4,625,151 | 11/1986 | Kataoka | 315/241 R |
| 4,800,323 | 1/1989 | Sikora | 315/241 R |

*Primary Examiner*—Eugene R. Laroche
*Assistant Examiner*—Son Dinh
*Attorney, Agent, or Firm*—Chilton, Alix & Van Kirk

[57] ABSTRACT

A power supply for intermittently energized loads, particularly gas discharge tubes employed as high intensity lights, has a pair of capacitances which are charged to a high voltage level to provide primary and secondary sources of anode voltage for the load. A coupling circuit impedes the discharge of the secondary anode voltage source capacitance when the primary anode voltage source capacitance is discharged through the load whereby a high voltage is present at the load, i.e., a discharge tube anode, immediately subsequent to the tube being extinguished thus reducing the time between successive firings of the tube. The current available for recharging the primary anode voltage source capacitance may also be increased during the time periods when the tube is being rapidly and repetitively fired.

18 Claims, 1 Drawing Sheet

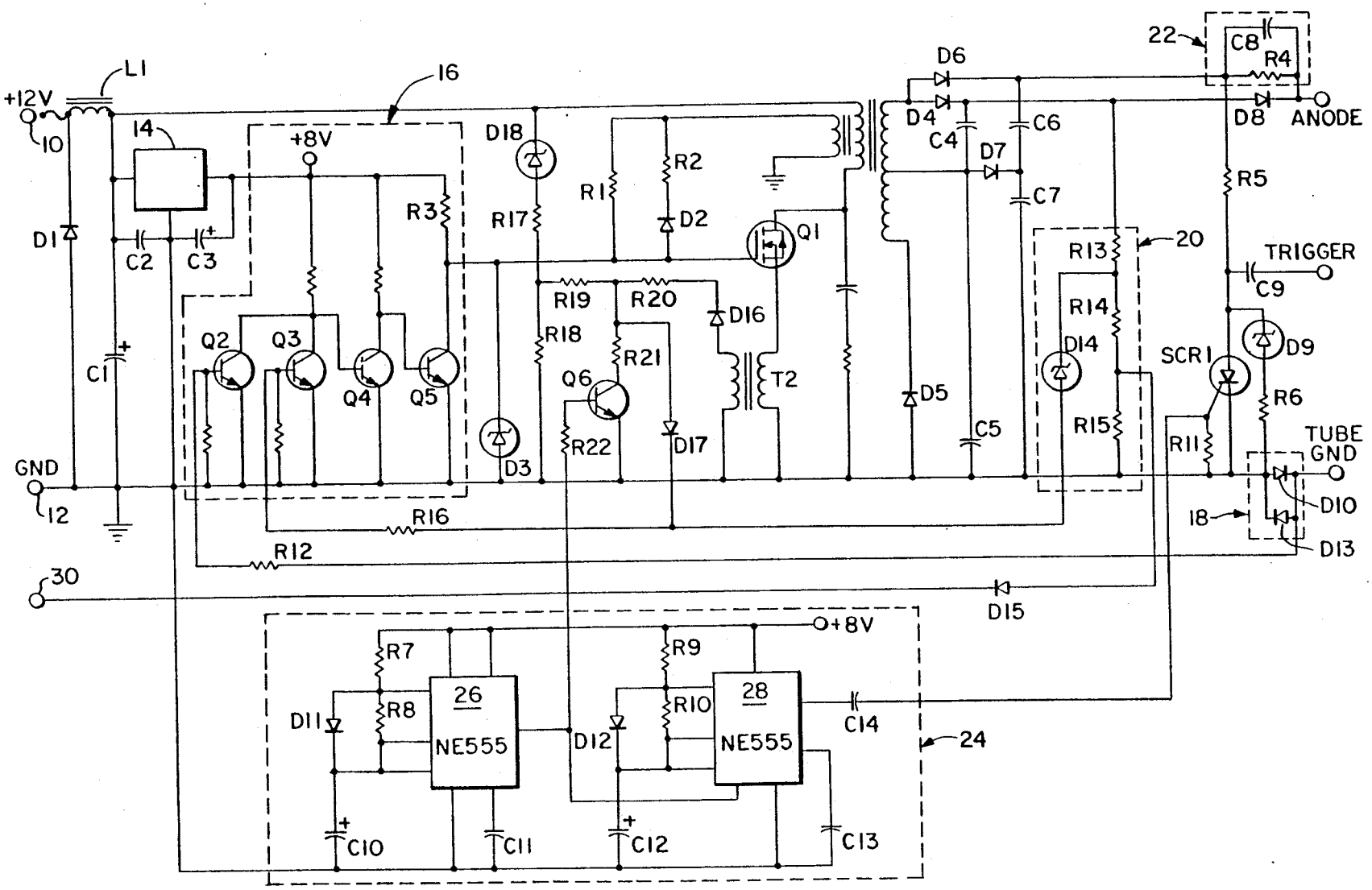
ANODE
TRIGGER
TUBE GND
C8
R4
D8
R5
C9
D9
R6
D10
D13
22
SCR1
R11
18
20
R13
R14
D14
R15
C6
C7
D7
D6
D4
C4
C5
D5
D15
24
+8V
C14
C13
Q1
T2
D16
R2
D2
R20
D17
R21
R1
R19
R18
Q6
R22
D18
R17
D3
28
NE555
R9
R10
C12
D12
26
NE555
R7
R8
C11
C10
D11
16
R3
Q5
Q4
Q3
Q2
R16
R12
+8V
C3
C2
14
L1
C1
+12V
10
D1
GND
12
30

POWER SUPPLY FOR INTERMITTENTLY OPERATED LOADS

BACKGROUND OF THE INVENTION (1) Field of the Invention

The present invention relates to electrical power converters and particularly to solid state circuits which may be utilized to supply a high DC voltage to an intermittently energized load, such as a gaseous discharge tube, from a low voltage direct current source. More specifically, this invention is directed to the furnishing of power to and the exercise of control over light generators, especially flash tubes, which are periodically energized to produce a preselected pattern of light emissions. Accordingly, the general objects of the present invention are to provide novel and approved apparatus and methods of such character.

(2) Description of the Prior Art

While not limited thereto in its utility, the present invention is well-suited for controlling the operation of warning lights and particularly for employment in warning light systems which include xenon flash tubes. Such warning light systems are well-known in the art and find application on emergency vehicles, aircraft and in other installations where it is considered necessary or desirable to attract attention by means of the generation of intermittent bursts of energy in the visible range of the frequency spectrum. For a disclosure of prior art power supplies for controlling the energization of gaseous discharge tubes, reference may be had to U.S. Pat. Nos. 3,515,973; 4,013,921 and 4,321,507.

Warning light systems are generally characterized by the type of light generator employed, i.e., an incandescent lamp or a gaseous discharge tube. With both types of light source, in order to enhance visibility, the system will cause light to be generated in pulses, i.e., a flashing light will attract attention much more readily than a steady light. Both types of light source have been found to have attributes and disadvantages. In order to enhance the visibility of the light produced by means of a gaseous discharge tube, power supply circuits have been devised which will cause such tubes to "fire" in a pattern of two to four intense flashes spaced closely in time followed by an "off" time, during which the energy storage capacitance of the power supply is recharged, the "off" time comprising 80% or more of the cycle. In the past, the off time between the individual flashes of such a serial pattern was, at minimum, 125 milliseconds while the duration of the flash was approximately 1 millisecond. Thus, notwithstanding the retention properties of the human eye, each individual flash was discernable and, most importantly, the off time comprised the major part of the cycle.

It should be apparent from the above discussion that there has been a long-standing desire to decrease the time between successive energizations of a gaseous discharge tube, whereby a series of pulses would be perceived by an observer as a single long duration flash, and to simultaneously increase the number of pulses in a series thus increasing the perceived on-time of the flash tube. However, in seeking to extend the perceived flash duration, restraints have been placed upon the power supply designer. Firstly, the overall physical size of the power supply and its power consumption had to remain reasonable and, in fact, was determined by the expected usage in vehicle applications. Secondly, the cost of the power supply could not place the flash tube type warning light system at a competitive disadvantage vis-a-vis a system employing incandescent lamps. Additionally, product reliability could not be compromised by, for example, subjecting components to excessive current flow or temperature.

SUMMARY OF THE INVENTION

The present invention satisfies the above-briefly discussed objectives by providing a novel and improved technique for exercising control over an intermittently energized load, particularly a gaseous discharge tube, and a power supply for use in the implementation of such technique. A power supply in accordance with the invention comprises primary and secondary flash tube anode voltage supplies, in the form of capacitances, which are charged to substantially the same high voltage level. The primary anode voltage supply is directly coupled to the flash tube anode while the secondary supply is coupled to the tube anode via a novel RC coupling circuit. The coupling circuit applies the voltage stored in the secondary supply capacitance to the tube anode but effectively prevents discharge thereof when the tube is ignited and the primary supply capacitance is discharged through the tube. Thus a high voltage is available to initiate second and subsequent discharges of energy through the flash tube from the primary voltage supply even though the primary supply has only partially recharged after an initial flash.

A power supply in accordance with the invention also includes means for increasing the maximum permissible current flow through the primary winding of a DC to AC converter, which supplies the power for charging a capacitance, when a flash tube load connected across the capacitance is in the conductive state thus increasing the power which may be delivered to the tube.

BRIEF DESCRIPTION OF THE DRAWING

The present invention may be better understood and its numerous objects and advantages will become apparent to those skilled in the art by reference to the accompanying drawing which is an electrical circuit schematic diagram of a preferred embodiment of a power supply in accordance with the invention.

DESCRIPTION OF THE DISCLOSED EMBODIMENT

The disclosed embodiment of the invention is intended for use in a vehicular application, where a low voltage direct current source is available, for providing power to and exercising control over a xenon flash tube, not shown, having an anode, cathode and trigger electrode with associated trigger transformer. When gas in the flash tube is excited, by inducing a high voltage across the flash tube trigger transformer secondary winding, current may flow therethrough thus producing light if the potential difference between the tube anode and cathode is sufficiently great to establish a low resistance path via ionized tube gas.

The low voltage DC source is connected across input terminals 10 and 12, terminal 10 being the positive polarity input terminal. A diode D1 is connected between terminals 10 and 12 to protect the circuit against an accidental reversal of source polarity. The source voltage is filtered, to remove any AC ripple impressed thereon, either by other equipment or by the operation of the power supply itself, by means of an input choke L1 and a capacitor C1. The filtered low DC voltage from the source is applied to the first end of the primary winding of a power transformer T1. The second end of the primary winding of transformer T1 is connected to ground via a solid state switch Q1 and the primary winding of a current sensing transformer T2. The solid state switch Q1, in the disclosed embodiment, comprises a power MOSFET. The source electrode of Q1 is connected directly to the primary winding of T1 and the drain electrode of Q1 is connected to a first end of the primary winding of current sensing transformer T2. Transformer T1 and switch Q1 form part of a conventional flyback type static inverter. The DC supply voltage is converted, by means of the static inverter, into a high AC voltage by means of the periodic gating of switch Q1 into the conductive state whereby current will periodically flow through the primary winding of T1.

The inverter further comprises a feedback network consisting of a feedback winding of transformer T1, resistors R1 and R2 and diode D2, this feedback network being connected between the gate of Q1 and ground. A DC bias voltage, which is applied to the gate of Q1, is developed by a low voltage regulator 14, having associated filter capacitors C2 and C3, and delivered to the gate via resistor R3. The gate of Q1 is protected against transients by a Zener diode D3. Application of the source voltage to terminals 10 and 12 will result in the biasing of Q1 into the conductive state. When Q1 is turned on, the resulting current flow through the primary winding of power transformer of T1 will induce a positive voltage in the feedback winding. This positive voltage is applied, via resistors R1 and R2 and diode D2 to the gate of Q1, thus driving Q1 into saturation. The current flow through the primary winding of T1 will be sensed by transformer T2 and, in the manner to be described below, a signal will be induced in the secondary winding of T2 which will cause Q1 to be turned off. As noted above, the switching of Q1 between the conductive and non-conductive states, and thus the periodic flow of current through the primary winding of T1, will induce a high voltage in the secondary winding of T1. The voltage induced in the secondary winding of T1 will be rectified and stored whereby a source of DC power is provided for the operation of the flash tube. The switching frequency of Q1, i.e., the conversion frequency of the inverter, will be much higher than the frequency of operation of the flash tube.

The signal which removes the positive bias from the gate of Q1, thereby turning off the switch, is provided by a dual input switching amplifier 16 defined by transistors Q2, Q3, Q4 and Q5. The emitters of all four of these transistors are connected directly to ground. The collector of Q5 is connected directly to the gate electrode of MOSFET Q1. Accordingly, when transistor Q5 is turned on, the MOSFET gate will be pulled to ground, thus turning Q1 off. The base of Q5 is connected to the collector of Q4 and the base of Q4 is connected to the collectors of Q2 and Q3. Transistors Q2, Q3 and Q5 are normally non-conductive while transistor Q4 is normally conductive. The control signal for transistor Q2 is provided by a deionization circuit 18 coupled to the flash tube. The control signal for transistor Q3 is derived, in the manner to be described below, from either an over-voltage sensing circuit 20 or the current sensing circuit which includes transformer T2.

The power coupled into the secondary winding of transformer T1 is delivered to a primary energy storage capacitance comprising series connected electrolytic capacitors C4 and C5 respectively by diodes D4 and D5. Energy is also stored in a secondary anode voltage storage capacitance which comprises, in the disclosed embodiment, series connected capacitors C6 and C7, capacitors C6 and C7 respectively being coupled to the transformer secondary winding by diodes D6 and D7. The primary and secondary storage capacitances are, in the disclosed embodiment, connected in parallel and thus will initially be charged to substantially the same "high" voltage level. Diode D7 balances the voltage across capacitors C6 and C7 and prevents capacitor C7 from discharging via the secondary winding of T1 when the flash tube load is in a conductive state.

The primary storage capacitance is directly coupled to the anode of a flash tube by a steering diode D8. The secondary storage capacitance is coupled to the flash tube anode by means of a voltage coupler circuit 22. Voltage coupler 22 includes a resistor R4 and capacitor C8. The time constant of the RC circuit comprising R4 and C8 determines the charging time of capacitor C8. The coupling circuit component valves, particularly the capacitance of capacitor C8, are selected to insure that capacitor C8 will recharge quickly after each firing of the flash tube, resistor R4 providing the charging path for capacitor C8. Diode D8 prevents discharge of the secondary storage capacitance by back-feeding when the voltage across the main storage capacitance falls below the voltage across the secondary storage capacitance. In one reduction to practice of the invention capacitor C8 delivered approximately one (1%) percent of the power stored in the secondary storage capacitance to the flash tube when the tube was "fired".

The control for the flash tube load on the power supply, i.e., the means for triggering the flash tube, comprises a second solid state switch which, in the disclosed embodiment, is a silicon controlled rectifier SCR1. However, any other solid state switching device could be employed, including switches responsive to both positive and negative going control pulses. The anode of SCR1 is coupled to the first end of the primary winding of the flash tube trigger transformer by trigger capacitor C9. The level to which trigger capacitor C9 is charged from the secondary anode voltage supply via resistor R5 is determined by a series connected Zener diode D9 and resistor R6 connected between the anode of SCR1 and ground. The diode D9 also protects SCR1 from excessive voltage. With capacitor C9 charged, the charging path for C9 including diode D13 in deionization circuit 18, the application of a positive pulse to the base of SCR1 will cause this solid state switch to be closed, i.e., the silicon controlled rectifier will be switched to the conductive state. Conduction of SCR1 will permit capacitor C9 to discharge through the primary winding of the flash tube trigger transformer, thereby resulting in a voltage being induced in the trigger transformer secondary winding of sufficient magnitude to ionize the gas in the tube. The ionization of the gas in the flash tube establishes a discharge path for the main storage capacitance C4, C5 through the flash tube to ground via deionization circuit 18.

The gating pulses for SCR1 are provided by a timing pulse generator 24 which, in the disclosed embodiment, comprises a pair of integrated circuit timers 26 and 28 connected in series. Timers 26 and 28 may, for example, comprise Signetics Corporation type NE/SE555 integrated circuits. Timer 26 operates in an astable mode and provides a square wave output. This square wave is applied as a gating signal input to timer 28 and is also applied to the base of a transistor Q6 for the purpose to be described below. The output frequency and duty cycle of timer 26 are adjustable and are determined by resistors R7, R8, capacitors C10 and C11 and diode D11.

The "low" output state of timer 26 clamps timer 28 in the off condition. When the output of timer 26 goes "high", timer 28 will generate a square wave output. In one reduction to practice of the invention, the width of the pulses provided by timer 26 was three hundered (300) milliseconds and the time between pulses was four hundred fifty (450) milliseconds. The width of the pulses provided by timer 28 was one (1) millisecond and the time between successive pulses was sixty (60) milliseconds. Accordingly, timer 28 provided a burst of six (6) one (1) millisecond duration pulses during each output pulse of timer 26. The frequency and duty cycle of timer 28 was selected in the same manner as in the case of timer 26 by means of resistors R9 and R10, capacitors C12 and C13 and diode D12. The output pulses from timer 26 are differentiated, by means of a differentiation circuit comprising capacitor C14 and resistor R11, and applied to the base of SCR1.

It is to be understood that the synchronized control pulses for transistor Q6 and switch SCR1 can be generated by several different techniques. Thus, for example, a timing oscillator driving a counter can be employed with the oscillator providing the switching pulses for SCR1.

When the flash tube load is triggered into conduction, thus establishing a discharge path for main storage capacitors C4 and C5, the heavy current which flows through the flash tube will also flow through deionization circuit diode D10. The voltage drop across diode D10, which is connected between the tube ground and the circuit ground, will be applied via resistor R12 to the base of normally nonconductive transistor Q2 of the switching amplifier 16. Transistor Q2 will thus be turned on, thereby clamping the base of transistor Q4 to ground and thus causing Q4 to switch to the nonconductive state. The turning off of transistor Q4 will result in transistor Q5 being turned on, thus clamping the base of MOSFET Q1 to ground, thereby shutting the inverter off. Accordingly, the converter is turned off during the time the flash tube is conducting. As noted above, diode D13 of the deionization circuit, which is connected between the circuit ground and the flash tube ground in opposite polarity to diode D10, provides a discharge path for trigger storage capacitor C9.

A voltage divider network comprising resistors R13, R14 and R15 is connected in parallel with the main storage capacitance C4, C5. A Zener diode D14 is connected between the junction of resistors R13 and R14 and the base of normally nonconductive transistor Q3 of switching amplifier !6, a resistor R16 being connected in series with diode D14. Diode D14 functions as a threshold detector for an over-voltage condition at the flash tube anode. Thus, if the voltage measured across the main storage capacitance exceeds a preselected level, determined by the voltage divider network, diode D14 will conduct and the voltage developed across resistor R16 will cause Q3 to be turned on and, in the same manner as occurs when transistor Q2 is turned on, the converter will be disabled. The junction of resistors R14 and R15 is connected to an input terminal 30 via a coupling diode D15. For high power operation of the flash tube, during daylight use for example, terminal 30 will be connected to ground thus short circuiting resistor R15. With R15 out of the circuit, the threshold point of the high voltage clamp circuit will be shifted, i.e., the magnitude of the flash tube anode voltage at which D14 conducts will be increased.

As noted above, a power supply in accordance with the disclosed embodiment of the present invention comprises a current sensing circuit which includes current sensing transformer T2 connected in series with switch Q1. A novel feature of the present invention resides in the fact that the current sensing circuit permits operation with a variable DC voltage source connected between input terminals 10 and 12. In addition to transformer T2, the current sensing circuit includes diodes D16 and D17, resistors R17, R18, R19, R20, R21 and R22, a Zener diode D18 and the above-mentioned transistor Q6. An output of the current sensing circuit, indicative of maximum permissible current flow through MOSFET Q1, is applied via resistor R16 to the base of transistor Q3 to disable the inverter in the manner discussed above. The series connection of Zener diode D18 and resistors R17 and R18 defines a switching voltage divider, the diode D18 functioning as a threshold detector/switch. The R17, R18 voltage divider becomes active only when the Zener diode D18 conducts, i.e., when the supply voltage exceeds sixteen (16) volts in one reduction to practice. When D18 is conductive, the voltage across resistor R18 will follow the source voltage. The series connection of resistors R18 and R19 determines the current sensing resistance, i.e., the voltage measured across these two resistors from the cathode of diode D17 to ground is the control voltage for D17. The voltage across resistor R18 will prebias diode D17 as a function of the instantaneous source voltage. Thus, the peak current through Q1 will be reduced as the source voltage increases and the power consumption of the circuit will remain the same as the source voltage fluctuates. The cathode of diode D17 is also connected, via the series connection of resistor R20 and diode D16, to the secondary winding of current sensing transformer T2.

The cathode of diode D17 is further connected, via resistor R21, to the collector of transistor Q6, the emitter of Q6 being grounded. The base of transistor Q6 is connected to the output of timer 26 via resistor R22. Transistor Q6 is, accordingly, turned on during the periods when the flash tube is firing. When transistor Q6 is conductive, resistor R21 will be connected in parallel with the series connection of resistors R18 and R19. The establishment of this parallel connection lowers the current sensing resistance and thus permits more current to flow through Q1 before the inverter, i.e., switch Q1, will be turned off. Thus, Q6 varies the load on the current sensing circuit and, during rapid firing of the flash tube, the peak current and consequently the power being delivered to the tube is increased.

During normal operation of the power supply, i.e., presuming that an over-current or over-voltage condition is not occurring, the operation of the inverter will result in the charging of the primary anode voltage supply capacitance C4, C5 and the secondary anode voltage supply capacitance C6, C7. The trigger capacitor C9 will also, in the manner described above, be charged. In a typical case, the anode voltage supply and trigger storage capacitances will be charged to approximately 500 volts. The flash tube anode will thus, before a trigger pulse is delivered to the trigger pulse transformer, be at a potential of approximately 500 volts.

When switch SCR1 is gated into the conductive state, thus firing the flash tube, the primary storage capacitance will discharge through the flash tube and the voltage across the primary storage capacitance will drop to, for example, approximately 40 volts. When SCR1 turns off, the SCR being self-commutating, the inverter will begin to recharge the main storage capacitance. The flash tube anode voltage will also momentarily drop, when the tube is fired, to approximately 40 volts. However, when SCR1 turns off, the flash tube anode voltage will almost immediately return to approximately the 500 volt level by virtue of the fact that the tube anode is coupled to the secondary storage capacitance by voltage coupler circuit 22, i.e., the flash tube anode will "feel" the high DC voltage after a very short time delay determined by the time constant of the coupling circuit. This results from the fact that the coupling circuit permits only a small fraction of the energy stored in the secondary storage capacitance to be discharged via capacitor C8 each time the flash tube fires. Accordingly, even though the elasped time since the last flash will have been sufficient for the primary storage capacitance to only partially recharge, to 150 volts for example, there will be sufficient energy stored in capacitor C8 to "kick start", i.e., to excite, the flash tube gas when the next trigger pulse is delivered to SCR1. The trigger storage capacitance will also quickly recharge from the secondary anode voltage supply. Thus, during the second and subsequent flashes of each burst of trigger pulses, the main storage capacitance will be discharged to a low voltage and then will partially recharge. The secondary anode voltage, i.e., the voltage across capacitors C6, C7, will however remain substantially constant. This permits the off time between successive firings of the flash tube to be greatly reduced when compared to the prior art. The resulting flashes of light may, in fact, be spaced sufficiently close in time so that, to the human eye, the flash tube appears to be on continuously during the repetitive pulse sequence. Additionally, as noted above, the circuit comprising transistor Q6 varies the maximum current which may flow through Q1 as a function of the state of conduction of the flash tube and thus the power supplied to the tube may be increased when compared to the prior art.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. Apparatus for providing power for the operation of a gaseous discharge tube, the tube having an anode and a cathode and containing an ionizable gas, the tube further having trigger means for exciting the gas therein whereby an electrical current may flow between the anode and the cathode thereof, said apparatus comprising:

a source of direct current;

means defining a primary anode voltage source for the tube, said primary voltage source defining means comprising a first capacitance which is connected to and charged from said direct current source;

means defining a secondary anode voltage source for the tube, said secondary voltage source defining means comprising a second capacitance which is connected to and charged from said direct current source;

means for connecting said primary voltage source to the flash tube anode, said connecting means preventing the feedback of energy from the tube anode to said primary voltage source;

means for coupling said secondary voltage source to the tube anode, said coupling means impeding the delivery of energy from said secondary voltage source to the tube when current is flowing between the anode and cathode thereof; and means for generating and applying packets of trigger pulses to the tube trigger means whereby the tube gas will periodically be ionized and said primary anode voltage source means capacitance will discharge therethrough, said trigger pulse packets each comprising a plurality of closely spaced trigger pulses.

2. The apparatus of claim 1 wherein said capacitances of said primary and secondary anode voltage source defining means are connected in parallel and are charged to substantially the same voltage level prior to the application of a packet of trigger pulses to the tube trigger means from said trigger pulse generating means.

3. The apparatus of claim 1 wherein said direct current source comprises:

converter means responsive to a low potential source of direct current for providing a high direct current potential, said converter means including a transformer having switch means connected in series with the primary winding thereof, said converter means further comprising means for causing said switch means to periodically change between conductive and non-conductive states; and wherein said apparatus further comprises:

means for varying the maximum current permitted to flow through said converter means transformer primary winding as a function of the operative state of the tube whereby the said maximum permissible current will increase during the generation of a packet of trigger pulses by said trigger pulse generating means.

4. The apparatus of claim 3 wherein said capacitances of said primary and secondary anode voltage source defining means are connected in parallel and are charged to substantially the same voltage level prior to the application of a packet of trigger pulses to the tube trigger means from said trigger pulse generating means.

5. The apparatus of 1 wherein said connecting means comprises:

steering diode means connected between said primary anode voltage source defining means first capacitance and the tube anode; and wherein said coupling means comprises:

a third capacitance connected between said secondary anode voltage source defining means second capacitance and the tube anode; and current limiting means connected in parallel with said third capacitance, said current limiting means preventing substantial discharge of said second capacitance when said first capacitance is being discharged.

6. The apparatus of claim 5 wherein said capacitances of said primary and secondary anode voltage source defining means are connected in parallel and are charged to substantially the same voltage level prior to the application of a packet of trigger pulses to the tube trigger means from said trigger pulse generating means.

7. The apparatus of claim 6 wherein said direct current source comprises:

converter means responsive to a low potential source of direct current for providing a high direct current potential, said converter means including a transformer having switch means connected in series with the primary winding thereof, said converter means further comprising means for causing said switch means to periodically change between conductive and non-conductive states; and wherein said apparatus further comprises:

means for varying the maximum current permitted to flow through said converter means transformer primary winding as a function of the operative state of the tube whereby the said maximum permissible current will increase during the generation of a packet of trigger pulses by said trigger pulse generating means.

8. The apparatus of claim 1 wherein the tube trigger means includes a trigger transformer and a trigger storage capacitance and wherein said apparatus further comprises:

means connecting said second capacitance to said trigger storage capacitance whereby said trigger storage capacitance is charged from said secondary anode voltage source defining means.

9. The apparatus of claim 6 wherein the tube trigger means includes a trigger transformer and a trigger storage capacitance and wherein said apparatus further comprises:

means connecting said second capacitance to said trigger storage capacitance whereby said trigger storage capacitance is charged from said secondary anode voltage source defining means.

10. The apparatus of claim 7 wherein the tube trigger means includes a trigger transformer and a trigger storage capacitance and wherein said apparatus further comprises:

means connecting said second capacitance to said trigger storage capacitance whereby said trigger storage capacitance is charged from said secondary anode voltage source defining means.

11. Apparatus for providing power to an intermittently operated gaseous discharge tube comprising:

a transformer, said transformer having at least a primary winding and a secondary winding;

solid sate switch means connected in series with said transformer primary winding, said switch means having an open and a closed state;

means for connecting said series connection of said switch means and transformer primary winding across a source of direct current whereby current may flow through said primary winding when said switch means is in the closed state;

means for sensing the current flow through said switch means and generating a signal commensurate with the magnitude thereof;

switch control means for causing said switch means to change state;

first connecting means for connecting a load including a gaseous discharge tube across said transformer means secondary winding, said first connecting means including means for storing energy for delivery to the load;

means for intermittently exciting the gas in the tube, whereby energy stored in said first connecting means will be delivered to the load, said means for exciting including:

first pulse generator means, said first pulse generator means providing pulses having a first predetermined duration; and second pulse generator means responsive to pulses provided by said first pulse generator means for producing a plurality of gating pulses during each output pulse of said first pulse generator means, the gating pulses produced by said second pulse generator means causing excitation of the gas in the gaseous discharge tube;

means responsive to said signals commensurate with current flow through said switch means for generating a switching command signal for said switch control means when the current flow through said switch means reaches a predetermined level; and means responsive to the output pulses of said first pulse generator means for varying the said predetermined current level at which said switching command signal is generated.

12. The apparatus of claim 11 wherein said flash tube has an anode and a cathode, the tube further having trigger means for exciting the gas therein, and wherein said first connecting means comprises:

means for rectifying the voltage induced in said transformer secondary winding;

means defining a primary anode voltage source for the tube, said primary voltage source defining means comprising a first capacitance which is connected to and charged from said rectifying means;

means defining a secondary anode voltage source for the tube, said secondary voltage source defining means comprising a second capacitance which is connected to and charged from said rectifying means;

second connecting means for connecting said primary voltage source defining means to the flash tube anode, said second connecting means preventing the feedback of energy from the tube anode to said primary voltage source; and means for coupling said secondary voltage source defining means to the tube anode, said coupling means impeding the delivery of energy from said secondary voltage source to the tube when current is flowing between the anode and cathode thereof.

13. The apparatus of claim 12 wherein second connecting means comprises steering diode means connected between said primary anode voltage source defining means first capacitance and the tube anode; and wherein said coupling means comprises:

a third capacitance connected between said secondary anode voltage source defining means second capacitance and the tube anode; and current limiting means connected in parallel with said third capacitance, said current limiting means preventing substantial discharge of said second capacitance when said first capacitance is being discharged.

14. The apparatus of claim 13, wherein said capacitances of said primary and secondary anode voltage source defining means are connected in parallel and are charged to substantially the same voltage level prior to each generation of a pulse by said first pulse generator means.

15. A method for providing power for the intermittent energization of a gaseous discharge tube, the tube having an anode and a cathode and containing an ionizable gas, the tube further having trigger means for exciting the gas therein whereby an electrical current may flow between the anode and cathode thereof, said method comprising the steps of:

charging a first capacitance to a high voltage level;

charging a second capacitance to a high voltage level discharging the first capacitance to a low voltage level through the tube hen the gas therein is in an excited state: and coupling the second capacitance to the tube anode and preventing substantial discharge of the second capacitance through the tube when the gas therein is in the excited state whereby a high voltage will be present at the tube anode immediately subsequent to cessation of the discharging of the first capacitance through the tube.

16. The method of claim 15 wherein the steps of charging are performed in parallel.

17. The method of claim 15 wherein the step of coupling comprises applying the voltage stored in the second capacitance to the tube anode via an RC circuit.

18. The method of claim 16 wherein the step of coupling comprises applying the voltage stored in the second capacitance to the tube anode via an RC circuit.

* * * * *